US007610945B2

(12) United States Patent
Bewlay et al.

(10) Patent No.: US 7,610,945 B2
(45) Date of Patent: Nov. 3, 2009

(54) RARE EARTH-BASED CORE CONSTRUCTIONS FOR CASTING REFRACTORY METAL COMPOSITES, AND RELATED PROCESSES

(75) Inventors: Bernard Patrick Bewlay, Niskayuna, NY (US); Frederic Joseph Klug, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 593 days.

(21) Appl. No.: 11/540,737

(22) Filed: Sep. 29, 2006

(65) Prior Publication Data

US 2008/0078520 A1 Apr. 3, 2008

(51) Int. Cl.
*B22C 9/10* (2006.01)
*B22C 1/00* (2006.01)

(52) U.S. Cl. ..... 164/28; 164/519; 164/529; 164/369

(58) Field of Classification Search ..... 164/28, 164/369, 516, 519, 529
See application file for complete search history.

(56) References Cited

U.S. PATENT DOCUMENTS 4,134,777 A 1/1979 Borom
4,164,424 A 8/1979 Klug et al.
4,703,806 A 11/1987 Lassow et al.
4,996,175 A 2/1991 Sturgis
5,409,871 A * 4/1995 Dodds et al. ..... 501/127
5,977,007 A 11/1999 Lassow et al.
6,152,211 A 11/2000 Klug et al.
6,237,671 B1 5/2001 Lassow et al.
6,345,663 B1 2/2002 Klug et al.
6,494,250 B1 12/2002 Frank et al.
6,578,623 B2 6/2003 Keller et al.
6,720,028 B1 4/2004 Haaland
7,296,616 B2 * 11/2007 Bewlay et al. ..... 164/519

* cited by examiner

*Primary Examiner*—Kevin P Kerns
(74) *Attorney, Agent, or Firm*—Francis T. Coppa

(57) ABSTRACT

A method of fabricating a core for a ceramic shell mold is disclosed. A porous core body is formed from at least about 50% by weight of at least one rare earth metal oxide. The core body is heated under heating conditions sufficient to provide the core with a density of about 35% to about 80% of its theoretical density. The core body is then infiltrated with a liquid colloid or solution of at least one metal oxide compound, e.g., rare earth metal oxides; silica, aluminum oxide, transition metal oxides, and combinations thereof. The infiltrated core body is then heated to sinter the particles without substantially changing the dimensions of the core body. Mold-core assemblies which include such a core body are also described. A description of processes for casting a turbine component, using the core, is also set forth herein.

35 Claims, No Drawings

RARE EARTH-BASED CORE CONSTRUCTIONS FOR CASTING REFRACTORY METAL COMPOSITES, AND RELATED PROCESSES

BACKGROUND OF THE INVENTION

This invention relates generally to refractory metal intermetallic composites and methods for preparing such materials. Some specific embodiments of the invention are directed to core constructions used in casting the materials.

Turbines and other types of high-performance equipment are designed to operate in a very demanding environment which usually includes high-temperature exposure, and often includes high stress and high pressure. A variety of new compositions have been developed to meet an ever-increasing threshold for high-temperature exposure. Prominent among such materials are the refractory metal intermetallic composites (RMIC's). Examples include various niobium-silicide alloys. (The RMIC materials may also include a variety of other elements, such as titanium, hafnium, aluminum, and chromium). These materials generally have much greater temperature capabilities than the current class of nickel- and cobalt-based superalloys. As an illustration, while many nickel-based superalloys have an operating temperature limit of about 1100° C., many RMIC alloys have an operating temperature in the range of about 1200° C.-1700° C. These temperature capabilities provide tremendous opportunities for future applications of the RMIC alloys (which are usually formed as single crystal and directionally-solidified castings). Moreover, the alloys are considerably lighter than many of the nickel-based superalloys.

A variety of techniques can be used to cast the RMIC materials into useful articles. Examples include investment casting, sometimes referred to as the "lost wax process". Gas turbine engine blades and vanes (airfoils) are usually formed by this type of casting technique.

Turbine engine components such as airfoils usually require a selected structure of interior passageways. In most instances, the passageways function as channels for the flow of cooling air. During operation of the turbine engine, the cooling air maintains the temperature of the component within an acceptable range.

The interior passageways in these components are typically formed by the use of one or more cores. (The cores can be used to form various other holes and cavities as well). In a typical process, a ceramic core is positioned within an investment shell mold. After casting of the part, the core is removed by conventional techniques. As described below, cores can be formed of many materials, e.g., ceramic oxides such as silica, alumina, and yttria (yttrium oxide).

In practice, green (unfired) cores are usually formed to desired core configurations by molding or pouring the appropriate ceramic material, with a suitable binder and other additives, into a suitably-shaped core die. After the green core is removed from the die, it is subjected to firing at elevated temperatures (usually above about 1000° C.) in one or more steps, to remove the fugitive binder, and to sinter and strengthen the core. As a result of the removal of the binder and any fillers, the fired ceramic core is porous.

When casting most types of high-performance components, cores for the molds must possess a very specific set of attributes. The core must be dimensionally stable and sufficiently strong to contain and shape the casting. Dimensional accuracy and stability are especially important in the case of many turbine components, e.g., airfoils having intricate internal passageways. Heating of the core at or above the casting temperature is often necessary prior to casting, to provide some temperature-stabilization within the core body. However, this heat treatment can lead to an undesirable amount of shrinkage. If the core were to exhibit shrinkage of greater than about 0.2%, the required dimensional accuracy and stability are difficult to achieve.

Moreover, in order to successfully cast high-melting materials like the RMIC's, the strength of the core after firing must often be very high, e.g., greater than about 500 psi. High casting temperatures also require that the core have excellent refractory characteristics.

While the core must exhibit dimensional stability and a certain degree of strength, it also must have a low "crush strength", so that the ceramic material of the core will crush before the metal being cast is subjected to tensile stress. (Otherwise, tensile stress could lead to mechanical rupture of the casting during solidification and cooling). Moreover, the microstructure and composition of the core must allow for relatively easy removal after casting, e.g., by the use of various leaching processes, along with other mechanical removal techniques. The porosity level of the core can be very important for minimizing compressive strength and facilitating core removal.

In many instances, the core must also be chemically inert. As an example, when casting highly reactive materials like the RMIC's, any reaction between the casting metal and certain components in the core can result in serious defects on the interior surfaces of the cast article. Niobium silicide castings are especially susceptible to adverse reaction when brought into contact at elevated temperatures with free silica and alumina from the core.

The attainment of all of the advantageous characteristics for ceramic cores by way of a single material composition at times remains elusive. As an illustration, while some core materials may exhibit the high strength required for casting, they fail to exhibit the low crush strength required to prevent hot-cracking of the metal during cooling. In other cases, core materials may exhibit the required degree of both strength and stability, but fail to possess the desired "leachability" characteristics. In still other cases, core materials meet or surpass specifications for all of these properties, but do not exhibit the chemical inertness required for casting RMIC's. Thus, there continues to be great interest in designing unique core constructions and core fabrication processes. These innovations should help to satisfy the future demands of efficiently casting high-quality metallic alloys and composites, such as the RMIC materials.

BRIEF DESCRIPTION OF THE INVENTION

One embodiment of the invention is directed to a method of fabricating a core for a mold, e.g., a ceramic shell mold. The method comprises the following steps:

(a) forming a porous core body according to selected dimensions from a composition comprising a binder and at least about 50% by weight of at least one rare earth metal oxide, based on the total weight of the core body;

(b) heating the core body under heating conditions sufficient to remove a substantial portion of the binder and provide the core with a density of about 35% to about 80% of its theoretical density;

(c) infiltrating the core body with a liquid colloid or solution which comprises particles of at least one metal oxide compound or precursor thereof, selected from the group consisting of rare earth metal oxides; silica, alumina, transition metal oxides, and combinations thereof; and then (d) heat-treating the particle-infiltrated core body under heating conditions sufficient to sinter the particles without substantially changing the dimensions of the core body.

Another embodiment is directed to a mold-core assembly, comprising the core fabricated according to the processes described here. The assembly can be used to cast turbine engine components.

A method for casting a turbine component formed of an RMIC material constitutes another embodiment of this invention. The method comprises the following steps:

(i) fabricating a core by:

(a) forming a porous core body, according to selected dimensions, from a composition comprising a binder and at least about 50% by weight of at least one rare earth metal oxide, based on the total weight of the core body;

(b) heating the core body under heating conditions sufficient to remove a substantial portion of the binder and provide the core with a density of about 35% to about 80% of its theoretical density;

(c) infiltrating the core body with a liquid colloid or solution which comprises particles of at least one metal oxide compound or precursor thereof, selected from the group consisting of rare earth metal oxides; silica, alumina, transition metal oxides, and combinations thereof; and (d) heat-treating the particle-infiltrated core body under heating conditions sufficient to sinter the particles without substantially changing the dimensions of the core body.

(ii) disposing the core formed in step (c) in a pre-selected position within a shell mold;

(iii) introducing a molten RMIC material into the mold structure;

(iv) cooling the molten material, to form the turbine component within the mold structure;

(v) separating the mold structure from the turbine component; and (vi) removing the core from the turbine component, so as to form selected interior cavities within the turbine component.

DETAILED DESCRIPTION OF THE INVENTION

The core body can comprise a variety of materials. Non-limiting examples include yttria, yttrium silicates, zirconium silicates, hafnium silicates, rare earth silicates, vitreous silica, alumina, aluminates, and various combinations thereof. In some specific embodiments, the core is formed from a composition which comprises at least about 50% by weight of at least one rare earth metal oxide, based on the total weight of the core body. The rare earth metals are as follows: lanthanum, cerium, praseodymium, neodymium, promethium, samarium, europium, gadolinium, terbium, dysprosium, holmium, erbium, thulium, ytterbium, and lutetium. In some specific embodiments, the rare earth metal oxide is selected from the group consisting of yttrium oxide, cerium oxide, erbium oxide, dysprosium oxide, ytterbium oxide, and combinations thereof. Furthermore, in some preferred embodiments, the core material comprises at least about 65% (and most preferably about 85%) by weight of one or more of the rare earth metal oxides.

Moreover, in some embodiments, the core body is formed from a composition comprising at least about 50% by weight to about 99% by weight yttria, based on total weight of the core body. In especially preferred embodiments, the level of yttria is at least about 75% by weight to about 99% by weight. As described below, the use of substantial amounts of yttria in the core can be very advantageous.

The core body can also contain other constituents. As an example, the material forming the core body usually contains at least one binder, which functions in part to hold together all of the ceramic constituents, prior to the initiation of any heat treatment. Non-limiting examples of binders include organometallic liquids; wax-based compositions; thermosetting resins, and combinations thereof. In some embodiments, the binder comprises a material which will polymerize when the core body is heat-treated. Moreover, in some cases, the binder comprises materials which will decompose and at least partially convert to a ceramic oxide, via the heat-treatment. The choice and amount of a particular binder will depend on various factors, such as the particular composition of the ceramic materials in the core body, and the manner in which the body is formed (discussed below). Usually, the binder (its total volume, as supplied) is present at a level in the range of about 30% by volume to about 65% by volume, based on the total volume of the core body. Methods for incorporating the binder into the core body material are well-known, e.g., using conventional, high-shear mixing equipment at room temperature or elevated temperatures. Solvents (aqueous or organic) can also be incorporated into the core body material, depending in part on the manner in which the core will be formed.

The core body can be formed by a variety of conventional techniques. Many references describe the manufacture and use of cores, e.g., U.S. Pat. No. 6,720,028 (Haaland); U.S. Pat. No. 6,494,250 (Frank et al); U.S. Pat. No. 6,345,663 (Klug et al); U.S. Pat. No. 6,152,211 (Klug et al); and U.S. Pat. No. 4,164,424 (Klug et al), which are all incorporated herein by reference. Specific, non-limiting examples of suitable techniques include injection molding, transfer molding, compression molding, die pressing, investment casting, coagulation casting, gel casting, slip casting, extrusion, and combinations thereof. As those skilled in the art understand, the core body is usually in the form of a "green", uncured product at this stage.

After the core body has been formed, it is subjected to a heat treatment. The heating conditions (time and temperature) are selected to achieve several objectives. First, the heating regimen is one which is sufficient to vaporize substantially all of the volatile material (e.g., the liquid solvent associated with the binder). The heat-treatment also serves to strengthen the green product, for better handling in subsequent process steps. Moreover, in many cases, e.g., with a wax binder, the heat treatment also removes a substantial portion of the binder, e.g., about 90% to about 100% of the weight of the binder originally incorporated into the core body. However, in other cases, e.g., when using a binder formed of a silica material such as colloidal silica, a portion of the binder (like silica) remains as part of the core.

The heating conditions are also selected to provide the core with a density of about 35% to about 80% of its theoretical density. In this manner, the core body includes a level of surface-connected porosity (i.e., porosity which is open to the external surface), which is important for subsequent processing steps. The porosity results in part from the particle size and the particle size-distribution of the starting powders, as well as the removal of the binder. The heating regimen is usually selected specifically to provide the required porosity level. In some specific embodiments, the core body is heated under conditions sufficient to provide the core with a density of about 50% to about 75% of its theoretical density. (Some guidelines regarding the size of the pore structures are further discussed below, relative to the infiltration step).

The temperature of the heat treatment for step (b) will depend on various factors, in addition to the desired density characteristics. These include: the particular constituents in the core body, including ceramic materials, binder materials, and solvents; the physical size of the core body; as well as the type of heating technique employed. In general, the heat-treatment temperature is typically in the range of about 900° C. to about 1800° C. When the core body is formed from a composition comprising at least about 50% by weight to about 99% by weight yttria (as described above), the heat-treatment temperature is usually in the range of about 1200° C. to about 1700° C.

The heating time will also depend on the factors described above, but usually ranges from about 15 minutes to about 10 hours. As those skilled in the art understand, higher temperatures sometimes compensate for shorter heating times, while longer heating times sometimes compensate for lower temperatures, within these ranges. Moreover, the heat treatment need not be carried out under one particular time/temperature schedule. As an example, lower temperatures could initially be used to primarily remove volatile materials and provide the core body with a minimum of green strength. These temperatures could be as low as the vaporization point of the lowest-boiling volatile component in the core body (and perhaps lower, e.g., if a vacuum was applied). The temperature could then be raised, rapidly or gradually, to the temperature required to provide the density levels discussed previously. Moreover, the temperature may be temporarily held at any "plateau", e.g., to allow for complete removal of solvent and volatile binder. Those skilled in the art will be able to select the most appropriate heating regimen for a particular situation. Heating is usually (though not always) carried out in a furnace. The furnace environment can vary, depending on the particular situation. As an example, heating can be carried out in air, nitrogen, a vacuum, hydrogen, hydrogen/water mixtures; an inert atmosphere (e.g., argon), and various combinations of the foregoing, when safety and practicality permit.

After the core body has been provided with the required amount of density (which can be equated with a desired amount of porosity), it is infiltrated with at least one metal oxide. As further described below, the metal oxide is usually in the form of particles. When used according to the described process, the metal oxide particles provide additional strength to the core, while also maintaining its dimensional stability and "leachability".

As mentioned above, a variety of metal oxides may be infiltrated into the core body. Examples include: rare earth metal oxides; silica, alumina, transition metal oxides, and combinations thereof (e.g., a combination of yttria and alumina). (As used herein "metal oxide" is meant to also include silica). In some specific embodiments, the rare earth metal oxides for step (c) are as follows: yttria, cerium oxide, erbium oxide, dysprosium oxide, ytterbium oxide, and combinations thereof. Non-limiting examples of the transition metal oxides include hafnium oxide, titanium oxide, zirconium oxide, and combinations thereof. (As used herein, "titanium oxide is meant to embrace TiO, $TiO_2$, or combinations thereof. Moreover, those skilled in the art understand that the metal oxides can exist in forms with a variety of metal-to-oxygen atomic ratios).

Choice of a particular metal oxide for infiltration into the core will depend in part on the properties desired for the core, as well as other factors. As an example, the use of rare earth metal oxides is often preferred because they are relatively non-reactive with casting metals such as niobium silicide, while still enhancing strength. In particular, yttria is sometimes especially preferred because of its relatively low cost. In other cases, silica is a preferred infiltrating material for various reasons. For example, silica can provide general strengthening to the core at lower temperatures, as compared to the use of some of the rare earths. In regard to the transition metal oxides, the inclusion of various amounts of infiltrating materials like titanium oxide, hafnium oxide, and zirconium oxide is in part based on the presence of such materials in the casting alloy itself.

As mentioned above, infiltration of the core body can be carried out with a liquid colloid of the metal oxide particles. As used herein, the term "colloid" is generally meant to describe a two-phase, liquid suspension of submicron components. In general, colloids include particles with very fine particle sizes, usually less than about 0.1 micron. Substantially all of the metal oxide particles mentioned herein can be used in the form of a liquid colloid. Many of these colloids are commercially available, while others can be prepared without undue effort. An example of a commercial, silica-based colloid is Ludox™ HS-30, available from DuPont and/or W. R. Grace & Co. An example of a commercial, alumina colloid is Nyacol™ AL20, available from Nyacol™ Nano Technologies, Inc., Ashland, Mass. This material contains alumina particles with an average particle size of about 50 nanometers. Moreover, yttria colloids and transition metal colloids are available as well, e.g., Nyacol™ Colloidal Yttria and Nyacol™ Colloidal Zirconia, respectively. (Nyacol™ Colloidal Yttria includes 14% by weight yttria solids, with the balance being water and acetic acid). As those skilled in the art understand, the liquid colloid can also contain a variety of additives used for conventional purposes, e.g., suspension agents, pH control agents, anti-foam agents, and deflocculants.

The desired size of the metal oxide particles in the liquid colloid is determined in part by the size of the pores in the core body. The heat treatment of the core body results in pores having a variety of pore sizes, as well as pore shapes. (The specific size and shape of the pores will depend on other factors as well, such as the type of core materials; type of binders, and the like). Typically (though not always), the larger pores will have an opening-size in the range of about 0.5 micron to about 40 microns. The smaller pores may have an opening in the range of about 0.5 micron to about 5 microns.

Thus, the particles in the liquid colloid should preferably have an average size smaller than the average pore-opening size. In this manner, the particles can effectively infiltrate the pores of the core body. In some specific embodiments, the average size of the particles in the colloid is less than about 1 micron. In certain applications, an average colloid particle size is less than about 0.1 micron.

The core body can be infiltrated with the liquid colloid by various techniques. Usually, the most efficient technique involves immersing the porous core body in a bath of the liquid. The period of time for immersion will vary to some degree, depending on factors like the core body size and composition; average pore size, and the type of metal oxide(s) being infiltrated. In general, immersion is usually carried out for about 1 minute to about 24 hours. In some cases, the immersion can be repeated one or more times, with drying and heating steps being carried out between the immersion steps. This type of cycle may further increase the amount of metal oxide which can be incorporated into the core body.

Moreover, in some instances, it is also preferable to apply a vacuum to enhance infiltration. Various techniques which employ the vacuum are possible. As one example, a vacuum could be applied to reduce the boiling temperature of the infiltrating liquid, followed by reapplying pressure to complete the infiltration. In some cases, capillary action enhances the movement of the liquid material fully into the pores of the core body.

The degree to which the core body is infiltrated also depends on many of the factors set forth above, such as average pore size. Typically, about 80% to about 100% of the available pore space is initially filled with liquid colloid, prior to any subsequent heat treatment. However, the amount of infiltration can sometimes vary significantly. (Subsequent drying/heating steps reopen the pores).

In some specific embodiments, the infiltration step is carried out under conditions which provide at least about 0.5% by weight of the metal oxide within the core body, based on the total weight of the core body. In embodiments which are especially preferred for some applications, the conditions are sufficient to provide at least about 2% by weight of the metal oxide within the core body. Various techniques can be used to determine how much infiltration of the pores in the cores has been achieved. For example, the change in mass of the core body can be measured by various analytical means. Alternatively, the core body could be placed in a vacuum chamber after immersion in the liquid colloid. Cessation of gas evolution (e.g., bubbling) from the core body would signify that substantially all of the air in the pores has been replaced by the infiltrating liquid. In some cases, it is desirable to remove excess amounts of the liquid colloid after infiltration is complete, e.g., by air blow-off, rinsing, and then drying.

In another embodiment, infiltration of the core body can be carried out by the use of an aqueous or non-aqueous solution of the infiltrating particles. For example, many of the metal oxide particles mentioned above can be used in the form of salts or metal-organics which are soluble in a variety of media, e.g., water, aliphatic alcohols, glycols, acetone, acetic acids, or other organic liquids. In some specific embodiments, the solution can comprise at least one nitrate, nitrite, acetate, carbonate, stearate, or organometallic compound. Those skilled in the art understand that these compounds typically function as metal oxide precursors, which form the desired metal oxide upon suitable heat treatment. Many other suitable metal-organic salts which are soluble in various liquids may be employed.

The various solutions of the infiltrating particles are commercially available, or can be prepared without undue effort. Many different compounds can be used as the source of the desired metal oxide. As a non-limiting example, yttria can be used in the form of yttrium nitrate, yttrium chloride, yttrium acetate, and/or yttrium sulfate solutions. Cerium salts are also known, e.g., cerium nitrate. Moreover, zirconium salts are also readily available, e.g., a cyclopentadienyl zirconium salt, or zirconium nitrate. A non-limiting example of a hafnium salt is hafnium chloride. Examples of aluminum salts are aluminum chloride, aluminum sulfate, and potassium alum. (These compounds are water-soluble). Many examples of titanium salts can also be provided, e.g., titanium chloride, titanium oxychloride; and titanium alcoholates such as titanium tetramethylate. Those skilled in the art will be able to select the most appropriate compound(s) for a given situation. Moreover, as in the case of liquid colloids, combinations of two or more metal oxides (or precursors thereof) can be incorporated into the solution.

The concentration of the metal oxide or metal oxide precursor in the solution will vary, depending in part on the amount of metal oxide which is to be incorporated into the core body. Moreover, infiltration of the core body can be undertaken in the same manner as in the case of the liquid colloid, e.g., by immersion in a suitable bath. In some cases, use of the solution of the metal oxide provides more rapid impregnation of the pore structure in the core body, as compared to using the liquid colloid. Furthermore, use of the solution may provide greater assurance that the desired metal oxide will enter the interior of the pores without blocking the pore openings, which can be very desirable in some cases.

The heat-treatment of step (d) can be carried out on the particle-infiltrated core body through the use of a variety of equipment, e.g., the furnaces described previously. Factors which influence the heating schedule are generally similar to some of the factors described above in heating step (b), e.g., core body materials, core body size, and heating technique employed. Additional factors include the type and size of metal oxide or metal oxide precursor.

In general, the heat-treatment temperature in step (d) is one which is sufficient to sinter the metal oxide particles, and/or to convert any metal oxide precursors to oxide form. In addition to the oxidation of metal constituents, the heat treatment causes reaction-bonding between the infiltrating particles and the surrounding surfaces or "walls" of the pores. The reaction-bonding in turn can increase the strength of the core.

While the heat-treatment temperature in step (d) is high enough to cause oxide formation and reaction-bonding (and consequently, core strength), it is low enough to prevent substantial change in the dimensions of the core body. Maintaining the temperature within this window is important for preparing cores which possess the desired characteristics. In general, heating temperatures in the range of about 1200° C. to about 1800° C. are usually sufficient to accomplish these objectives. In the case of a core body comprising at least about 65% by weight of one or more of the rare earth metal oxides., the heating temperature is usually in the range of about 1400° C. to about 1700° C. (Moreover, as in the case of heat-treatment step (b), variations in the heating regimen in step (d) are possible, e.g., adjustments to heating times; a graduated increase in temperature to the required temperature level; intermittent hold times; and the like).

It should also be understood that in some situations, at least a portion of heat treatment step (d) can be carried at a subsequent time. For example, the heat treatment, or the final stages of the heat treatment, could be carried out after the core has been disposed within a suitable die or shell mold, as described below. Those skilled in the art will be able to determine the most appropriate heating sequence for a given situation.

The heat treatment of the infiltrated core usually results in the formation of a solid solution of the metal oxide constituents with the core material itself. In general, the infiltrating elements or compounds tend to form various types of oxides as part of the solid solution. (As used herein, an "oxide" refers to a compound in which at least one metallic atom or compound is bonded to at least one oxygen atom). Thus, as an example, a yttria-containing core material, infiltrated with alumina and then heat-treated, results in the conversion of free alumina to various yttrium aluminates (or combinations thereof). Similarly, a rare earth-containing core material infiltrated with metal oxides such as hafnium oxide, zirconium oxide or titanium oxide (and then heat-treated) results in the formation of various rare earth-hafnates, -zirconates or -titanates, respectively. Rare earth-containing core materials, infiltrated with silica (e.g., by way of colloidal silica) and then heat-treated, will result in the formation of various rare earth-silicates.

As one illustration, a yttria-containing core can be infiltrated with silica, according to the methods set forth previously. As a specific example, at least about 50 weight % of the infiltrating metal oxide could comprise silica. (If a resinous silicone material were used as a silica source, the proportion of silica in the overall metal oxide infiltrating material may be even higher, e.g., about 80 weight %. In this instance, some dilution of the resin may be necessary to ensure that the pores remain substantially open). The subsequent heat treatment results in the conversion of free silica to at least one yttrium silicate compound. (The core material may also comprise free yttria). In embodiments which are especially preferred for some end uses, the heating conditions are selected so as to produce yttrium monosilicate (known as $Y_2SiO_5$ or $Y_2O_3.SiO_2$), in preference to other yttrium silicate compounds. Yttrium monosilicate exhibits excellent refractory characteristics and chemical inertness, which can be very important attributes in the casting of turbine parts made of RMIC's. In some specific embodiments, at least about 60% by volume of the total amount of yttrium silicate is in the form of yttrium monosilicate. In preferred embodiments, the level of yttrium monosilicate is at least about 80% by volume.

At this stage, the infiltrated, fired core is ready for use in any casting or molding operation. For example, the cores can be used in the investment casting of turbine engine components. In such a process, the core is usually employed as part of a mold-core assembly, to form the component, e.g., a turbine blade. Typically, the core and appropriate ancillary material known to those skilled in the art (e.g., positioning pins and support pins, sprues, gates, etc) are positioned in a die, appropriately shaped in accordance with the design of the component to be cast. Wax is then usually injected into the die and solidified, to form a wax model. The wax model, containing the embedded core, is repeatedly dipped in ceramic slurry, to form a ceramic shell mold around the wax pattern.

After removing the wax, all that remains is the ceramic core, disposed in and attached to the ceramic shell mold, thereby forming the mold-core assembly referred to above. After casting the component by solidifying molten metal in the mold-core assembly, the ceramic mold is removed, e.g., by chemical or mechanical means. The core can then be leached out by conventional techniques, e.g., use of a chemical removal agent. The strength and dimensional stability of the core prepared according to embodiments of this invention represent important advantages in the overall casting process. Moreover, the porous microstructure can considerably enhance the effectiveness of the leaching process after casting has been completed.

Although this invention has been described in terms of specific embodiments, they are intended for illustration only, and should not be construed as being limiting in any way. Thus, it should be understood that modifications can be made thereto, which are within the scope of the invention and the appended claims. All of the patents, patent applications, articles, and texts which are mentioned above are incorporated herein by reference.

The invention claimed is:

1. A method of fabricating a core for a mold, comprising the following steps:

(a) forming a porous core body according to selected dimensions from a composition comprising a binder and at least about 50% by weight of at least one rare earth metal oxide, based on the total weight of the core body;

(b) heating the core body under heating conditions sufficient to remove a substantial portion of the binder and provide the core with a density of about 35% to about 80% of its theoretical density;

(c) infiltrating the core body with a liquid colloid or solution which comprises particles of at least one metal oxide compound or precursor thereof, selected from the group consisting of rare earth metal oxides; silica, alumina, transition metal oxides, and combinations thereof; and then (d) heat-treating the particle-infiltrated core body under heating conditions sufficient to sinter the particles without substantially changing the dimensions of the core body.

2. The method of claim 1, wherein the rare earth metal oxide of step (a) is selected from the group consisting of yttrium oxide, cerium oxide, erbium oxide, dysprosium oxide, ytterbium oxide, and combinations thereof.

3. The method of claim 1, wherein the composition of step (a) comprises at least about 65% of at least one rare earth metal oxide.

4. The method of claim 1, wherein the rare earth metal oxide comprises yttria.

5. The method of claim 1, wherein the porous core body of component (a) is formed by a molding process.

6. The method of claim 1, wherein the porous core body of component (a) is formed by a process selected from the group consisting of injection molding, transfer molding, compression molding, die pressing, investment casting, coagulation casting, gel casting, slip casting, extrusion, and combinations thereof.

7. The method of claim 1, wherein the core body is heated in step (b) under heating conditions sufficient to provide the core with a density of about 50% to about 75% of its theoretical density.

8. The method of claim 1, wherein the heat-treatment temperature of step (b) is in the range of about 900° C. to about 1800° C.

9. The method of claim 1, wherein the heat treatment of step (b) is carried out in a furnace.

10. The method of claim 1, wherein the binder comprises at least one material selected from the group consisting of organometallic liquids; wax-based compositions; thermosetting resins, and combinations thereof.

11. The method of claim 1, wherein the rare earth metal oxides of step (c) are selected from the group consisting of yttrium oxide, cerium oxide, erbium oxide, dysprosium oxide, ytterbium oxide, and combinations thereof.

12. The method of claim 1, wherein the transition metal oxides of step (c) are selected from the group consisting of hafnium oxide, titanium oxide, zirconium oxide, and combinations thereof.

13. The method of claim 1, wherein step (c) comprises infiltration with a liquid colloid.

14. The method of claim 13, wherein step (c) is carried out by immersing the porous core body in the liquid colloid.

15. The method of claim 13, wherein the core body treated according to step (b) comprises pores having an average, selected pore-opening size, and the particles in the liquid colloid have an average size smaller than the average pore-opening size, to permit the particles to infiltrate the pores of the core body.

16. The method of claim 15, wherein the average size of the particles in the colloid is less than about 1 micron.

17. The method of claim 16, wherein the average size of the particles in the colloid is less than about 0.1 micron.

18. The method of claim 1, wherein step (c) comprises infiltration with an aqueous or non-aqueous solution of the infiltrating particles.

19. The method of claim 18, wherein the solution comprises a precursor of the material forming the particles.

20. The method of claim 18, wherein the solution comprises at least one nitrate, nitrite, acetate, carbonate, stearate, or organometallic compound of the infiltrating particles.

21. The method of claim 1, wherein infiltration step (c) is carried out under conditions which provide at least about 0.5% by weight of the metal oxide within the core body, based on the total weight of the core body.

22. The method of claim 21, wherein infiltration step (c) is carried out under conditions which provide at least about 2% by weight of the metal oxide within the core body.

23. The method of claim 1, wherein the heat treatment of step (d) is sufficient to remove the liquid component of the colloid while the particles remain in the pores, so as to maintain substantially open, surface-connected porosity in the core body.

24. The method of claim 1, wherein the heat treatment of step (d) is carried out at a temperature in the range of about 1200° C. to about 1800° C.

25. The method of claim 1, wherein the heat treatment of step (d) is at least partially carried out after the core body is disposed in a die or a shell mold.

26. The method of claim 1, wherein the heat treatment of step (d) is sufficient to result in the formation of rare earth-silicates.

27. The method of claim 1, wherein the mold is a ceramic shell mold.

28. The method of claim 1, wherein the core body comprises at least about 50% by weight yttria; and the core body is infiltrated in step (c) with an oxide which comprises silica.

29. The method of claim 28, wherein heat-treatment step (d) is carried out under conditions which convert substantially all silica to at least one yttrium silicate compound.

30. The method of claim 29, wherein the yttrium silicate compound comprises yttrium monosilicate.

31. A core for a mold, fabricated by the method of claim 1.

32. A method of fabricating a core for a ceramic shell mold, comprising the following steps:

(a) forming a porous core body according to selected dimensions from a composition comprising a binder and at least about 75% by weight of yttria, based on the total weight of the core body;

(b) heating the core body under heating conditions sufficient to remove a substantial portion of the binder and provide the core with a density of about 50% to about 75% of its theoretical density;

(c) infiltrating the core body with a liquid colloid or solution which comprises particles of at least one metal oxide compound or precursor thereof, wherein the metal oxide compound or precursor comprises at least about 50% by weight silica; and then (d) heat-treating the particle-infiltrated core body under heating conditions sufficient to sinter the particles without substantially changing the dimensions of the core body; and to convert substantially all silica to at least one yttrium silicate compound.

33. The method of claim 32, wherein the heat-treatment temperature of step (b) is in the range of about 900° C. to about 1800° C.;

the heat-treatment temperature of step (d) is in the range of about 1200° C. to about 1800° C.; and the yttrium silicate compound comprises yttrium monosilicate.

34. A method for casting a turbine component formed of a refractory metal intermetallic composite (RMIC) material, comprising the following steps:

(i) fabricating a core by:

(a) forming a porous core body, according to selected dimensions, from a composition comprising a binder and at least about 50% by weight of at least one rare earth metal oxide, based on the total weight of the core body;

(b) heating the core body under heating conditions sufficient to remove a substantial portion of the binder and provide the core with a density of about 35% to about 80% of its theoretical density;

(c) infiltrating the core body with a liquid colloid or solution which comprises particles of at least one metal oxide compound or precursor thereof, selected from the group consisting of rare earth metal oxides; silica, alumina, transition metal oxides, and combinations thereof; and (d) heat-treating the particle-infiltrated core body under heating conditions sufficient to sinter the particles without substantially changing the dimensions of the core body;

(ii) disposing the core in a pre-selected position within a shell mold;

(iii) introducing a molten RMIC material into the shell mold;

(iv) cooling the molten material, to form the turbine component within the shell mold;

(v) separating the shell mold from the turbine component; and (vi) removing the core from the turbine component, so as to form selected interior cavities within the turbine component.

35. The method of claim 34, wherein at least a portion of heat-treatment step (i)(d) is carried out between step (ii) and step (iii).

* * * * *